US011035193B2

(12) United States Patent
Ross

(10) Patent No.: US 11,035,193 B2
(45) Date of Patent: Jun. 15, 2021

(54) TUBING HANGER ASSEMBLY WITH WELLBORE ACCESS, AND METHOD OF SUPPLYING POWER TO A WELLBORE

(71) Applicant: INNOVEX DOWNHOLE SOLUTIONS, INC., Houston, TX (US)

(72) Inventor: Stephen C. Ross, Odessa, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 92 days.

(21) Appl. No.: 16/216,660

(22) Filed: Dec. 11, 2018

(65) Prior Publication Data

US 2019/0203554 A1 Jul. 4, 2019

Related U.S. Application Data

(60) Provisional application No. 62/611,490, filed on Dec. 28, 2017.

(51) Int. Cl.

| | |
|---|---|
| ***E21B 33/04*** | (2006.01) |
| ***E21B 17/02*** | (2006.01) |
| ***E21B 40/00*** | (2006.01) |

(52) U.S. Cl.

CPC ..... *E21B 33/0415* (2013.01); *E21B 17/023* (2013.01); *E21B 33/0407* (2013.01); *E21B 40/00* (2013.01)

(58) Field of Classification Search

CPC .. E21B 33/04; E21B 33/0407; E21B 33/0415; E21B 17/023; E21B 17/003; E21B 17/028; E21B 40/00; E21B 23/14; E21B 17/00; E21B 17/02; E21B 33/03; E21B 33/038

See application file for complete search history.

(56) References Cited

U.S. PATENT DOCUMENTS

| | | | | |
|---|---|---|---|---|
| 3,437,149 | A | | 4/1969 | Cugini et al. |
| 3,885,521 | A | * | 5/1975 | von Arx ..... B05C 7/08 118/105 |
| 3,945,700 | A | | 3/1976 | Didier |
| 4,053,201 | A | | 10/1977 | Grappe |
| 4,154,302 | A | | 5/1979 | Cugini |
| 4,181,394 | A | | 1/1980 | Dodge |
| 4,193,655 | A | | 3/1980 | Herrmann, Jr. |

(Continued)

*Primary Examiner* — D. Andrews
*Assistant Examiner* — Manuel C Portocarrero
(74) *Attorney, Agent, or Firm* — MH2 Technology Law Group LLP

(57) ABSTRACT

A tubing hanger assembly for suspending a tubing string within a wellbore. The tubing hanger assembly comprises a tubing head and a tubing hanger. The tubing hanger lands within the tubing head to gravitationally support a string of production tubing. The tubing hanger includes an auxiliary port extending from the upper end to the lower end. The auxiliary port receives unsheathed conductive wires from a power cable. To secure the conductive wires within the auxiliary port and to prevent shorting, the conductive wires are placed within a unique disc stack. The tubing hanger assembly further includes a bottom plate residing along the lower end of the tubular body and securing the disc stack. Thus, the tubing hanger assembly is arranged to receive a continuous power cable from a power source into the wellbore, through the auxiliary port, without the conductive wires being spliced.

16 Claims, 14 Drawing Sheets

(56) References Cited

U.S. PATENT DOCUMENTS

| | | | | |
|---|---|---|---|---|
| 4,266,844 | A | 5/1981 | Chelminski | |
| 4,583,804 | A | 4/1986 | Thompson | |
| 4,693,534 | A | 9/1987 | Clark | |
| 4,740,176 | A | 4/1988 | Marks et al. | |
| 4,927,386 | A | 5/1990 | Neuroth | |
| 5,567,170 | A | 10/1996 | Kroeber | |
| 5,626,190 | A | 5/1997 | Moore | |
| 5,642,780 | A | 7/1997 | Moore | |
| 5,732,771 | A | 3/1998 | Moore | |
| 5,762,135 | A | 6/1998 | Moore | |
| 5,823,256 | A | 10/1998 | Moore | |
| 6,202,743 | B1 | 3/2001 | Moore | |
| 6,308,732 | B1 | 10/2001 | Herndon | |
| 6,443,780 | B2 | 9/2002 | Wilbourn et al. | |
| 6,702,015 | B2 | 3/2004 | Fielder, III et al. | |
| 8,641,113 | B1 * | 2/2014 | Russell | E21B 31/00 294/86.1 |
| 8,641,457 | B2 | 2/2014 | Watson et al. | |
| 8,716,600 | B2 | 5/2014 | Kehl et al. | |
| 8,981,224 | B2 | 3/2015 | Kehl et al. | |
| 9,316,062 | B2 | 4/2016 | Emerson et al. | |
| 9,388,654 | B2 | 7/2016 | Urrego Lopera et al. | |
| 9,793,642 | B2 | 10/2017 | Natter et al. | |
| 9,912,139 | B2 | 3/2018 | Strikovski | |
| 2005/0051341 | A1 * | 3/2005 | Khazanovich | E21B 33/0385 166/379 |
| 2009/0317997 | A1 * | 12/2009 | Watson | E21B 17/023 439/190 |
| 2011/0162881 | A1 | 7/2011 | Schipporeit | |
| 2011/0233307 | A1 * | 9/2011 | Ohno | F02M 61/162 239/463 |
| 2015/0233204 | A1 * | 8/2015 | Tarlton | E21B 17/042 166/379 |

* cited by examiner

TUBING HANGER ASSEMBLY WITH WELLBORE ACCESS, AND METHOD OF SUPPLYING POWER TO A WELLBORE

CROSS REFERENCE TO RELATED APPLICATIONS

This application claims the benefit of U.S. Ser. No. 62/611,490 filed Dec. 28, 2017. That application is entitled "Tubing Hanger Assembly With Wellbore Access, and Method of Supplying Energy to a Wellbore," and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to an assembly for providing line power from a power box at the surface, and down to an electrical submersible pump. The invention also relates to a method of accessing a wellbore through a tubing hanger using a series of protective discs.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

It is common to place several strings of casing having progressively smaller outer diameters into the wellbore. In this respect, the process of drilling and then cementing progressively smaller strings of casing is repeated several times until the well has reached total depth. The final string of casing, referred to as a production casing, is typically cemented into place.

As part of the completion process, the production casing is perforated at a desired level. Alternatively, a sand screen may be employed at a lowest depth in the event of an open hole completion. Either option provides fluid communication between the wellbore and a selected zone in a formation. In addition, production equipment such as a string of production tubing, a packer and a pump may be installed within the wellbore.

During completion, a wellhead is installed at the surface. Fluid gathering and processing equipment such as pipes, valves and separators are also provided. Production operations may then commence.

In typical land-based production operations, the wellhead includes a tubing head and a tubing hanger. The tubing head seals the wellbore at the surface while the tubing hanger serves to gravitationally support the long string of production tubing. The tubing hanger is landed along an internal shoulder of the tubing head while the tubing string extends down from the tubing hanger proximate to a first pay zone.

In connection with hanging the tubing in the wellbore, it is sometimes desirable to run an electric line to provide power to downhole components. Such components may include a resistive heater or an electric submersible pump (or "ESP"). To provide such access, a plug-in joint has been provided along the wellhead wherein a power cable at the surface is spliced and placed in electrical communication with a power cable in the wellbore leading down to the equipment to be powered. The plug-in joint is exposed to high pressure fluids, which are also frequently corrosive.

U.S. Pat. No. 4,583,804 entitled "Electric Feedthrough System," sought to provide a wellhead arrangement for running a power cable at the surface through a wellhead. Such a wellhead arrangement offered a rigid housing adapter along the tubing head to accommodate and to isolate the electric line. However, the housing utilized conductive copper rods that required the three wires of an armored electrical cable to be stripped of their insulating casing and separated, and then further exposed to be spliced to the copper rods. The spliced wires leave the wellhead vulnerable to volatile production fluids and shorting.

Accordingly, a need exists for an improved tubing hanger that provides access to the wellbore during well completion. Further, a need exists for a tubing hanger assembly that enables the pass-through of electrical conduit through the wellhead without exposing uninsulated conductive wires. Still further, a need exists for an improved tubing hanger that offers a port that is offset from but parallel with the tubing string for receiving conduit, such as electrical wiring that provides power to an electrical submersible pump, without splicing and connecting conductive wires along the wellhead.

SUMMARY OF THE INVENTION

A tubing hanger assembly for gravitationally supporting a production tubing string within a wellbore is provided herein. The tubing hanger assembly generally comprises a tubing head and a tubing hanger. Beneficially, the tubing hanger assembly allows the operator to install an insulated power cable through the wellhead and into the wellbore without the splicing of conductive wires along the wellhead or completely removing insulation.

The tubing head has an upper end and a lower end, and defines a central bore having a conical surface. The upper end comprises a flange having a plurality of radially disposed holes. The holes permit the wellhead to be bolted to other components that make up a so-called Christmas Tree at the surface.

The tubing hanger is configured to reside along the central bore of the tubing head and over the wellbore. The tubing hanger comprises a central bore that extends from its upper end to its lower end. The tubing hanger includes a beveled surface along an outer diameter. This beveled surface lands on the conical surface of the tubing head to provide gravitational support for the production tubing.

The tubing hanger defines a tubular body. The tubular body has an upper threaded end and a lower threaded end. The lower threaded end is configured to threadedly mate with the upper end of a joint of production tubing. Specifically, the joint of production tubing is the uppermost joint of tubing in a long tubing string that extends down into the wellbore. Those of ordinary skill in the art will know that the upper end of a joint of tubing string is referred to as the "box end." A male-to-male pup joint may be used to connect the tubing hanger to the uppermost joint of tubing.

Beneficially, the tubing hanger provides an auxiliary port that is offset from, but that is co-axial with, the central bore. The auxiliary port also extends from the upper end to the lower end of the tubular body.

The tubing hanger assembly also comprises:

at least one elastomeric disc configured to reside within the auxiliary port and to receive separated conductive wires of an electric power cable; and at least one rigid disc also configured to reside within the auxiliary port and to receive separated conductive wires of an electric power cable.

In addition, the tubing hanger assembly comprises a bottom plate. The bottom plate resides along the lower end of the tubular body and gravitationally supports the at least one elastomeric disc and the at least one rigid disc. Preferably, the elastomeric discs and the rigid discs are stacked in series, in alternating arrangement, to form a disc stack.

Preferably, the elastomeric discs are fabricated from neoprene, while the rigid discs are fabricated from a polycarbonate material such as so-called PEEK. The at least one elastomeric disc is configured to expand within the auxiliary port when compressed in order to seal the conductive wires and the auxiliary port from reservoir fluids. At the same time, the at least one rigid disc is configured to retain rigidity within the auxiliary port during installation and during production operations to keep the conductive wires separated from the steel material making up the tubular body.

Preferably, the at least one elastomeric disc comprises at least two elastomeric discs and the at least one rigid discs comprises at least two rigid discs. The elastomeric discs and the rigid discs are alternatingly stacked, in series, within the auxiliary port to form the disc stack.

In one embodiment:

each of the at least two elastomeric discs comprises three central through-openings for receiving respective conductive wires of the power cable;

each of the at least two rigid discs also comprises three central through-openings for receiving respective conductive wires of the power cable;

the central through-openings of the elastomeric discs and the central through-openings of the rigid discs are aligned along the disc stack; and each of the conductive wires retains its own plastic insulation along the auxiliary port.

In a preferred embodiment, the bottom plate comprises a central through-opening for receiving the conductive wires below the disc stack en route to the wellbore. The bottom plate is secured to the bottom end of the tubular body, such as by means of bolts. Preferably, sufficient discs are placed along the disc stack so that when the bottom plate is secured, the operator must apply compression to force the elastomeric discs to expand and to fill the auxiliary port. In this way, a fluid seal is formed by causing the elastomeric discs to extrude around the conductive wires. At the same time, the rigid discs provide separation of the conductive wires from the metal body of the tubing hanger, preventing arcing or shorting.

In one aspect:

each of the at least two elastomeric discs is cut in half along the central through-openings to receive respective conductive wires; and each of the at least two rigid discs is also cut in half along the central through-openings to receive respective conductive wires.

This permits each of the respective disc halves to be placed back together before loading into the auxiliary port.

In one embodiment, the tubing hanger further comprises a pair of elongated alignment pins. In this instance, each of the at least two elastomeric discs and each of the at least two rigid discs comprises a pair of opposing through-openings configured to receive a respective alignment pin along the disc stack. This keeps the three central through openings aligned.

In one arrangement, the tubing hanger further comprises a rigid, non-conductive sleeve residing at a top of the disc stack. The sleeve accommodates space along the auxiliary port, reducing the number of discs required. The sleeve lands on an upper shoulder along the auxiliary port and provides a smooth transition into the auxiliary port. In another arrangement, an uppermost disc and a lowermost disc of the rigid discs along the disc stack have a thickness that is greater than a thickness of the intermediate rigid discs.

In operation, the tubing head is placed over the wellbore as part of a well head. The tubing head seals the wellbore in order to isolate wellbore fluids during production operations.

A power cable is run into the wellbore. Typically, the power cable is run with the joints of production tubing and is periodically clamped. Once the production string has been run into the wellbore, the uppermost joint of tubing is threadedly connected to the tubing hanger. At this point, the outer conductive sheath is removed from a length of the power cable, revealing three insulated conductive wires.

The conductive wires are laid out separately along the disc stack. More specifically, the conductive wires are placed along disc halves of the stack, with each wire being placed along one of the three central through-openings. Once the wires are in place, the mating disc halves are put back in place and the disc stack is inserted into the auxiliary port from the bottom end. Preferably, the non-conductive rigid sleeve is placed above the disc stack.

The operator installs the bottom plate onto the bottom of the tubing hanger. The conductive wires pass through a central through-opening in the bottom plate en route to the wellbore. The disc stack is now held in place and the power cable is able to pass through the wellhead without splicing. Once the wires have extended below the auxiliary port, they are once again in their sheathed state.

As part of the installation procedure, the operator will make a determination as to how many elastomeric discs and rigid discs will make up the disc stack. Ideally, the disc stack will be longer than the space available within the auxiliary port, taking into account the length of the non-conductive sleeve (if used). The operator will use the bottom plate to push on the disc stack, compressing the elastomeric discs so that a series of annular seals is provided along the auxiliary port. Pushing on the disc stack reduces its length, allowing the full stack to fit within the auxiliary port.

It is noted that the present tubing hanger assembly may also be used in running other communications lines into the wellbore. For example, fiber optic cable may be passed through the auxiliary port, either in addition to or in lieu of the power cable. In one aspect, the communications line is a power cable that provides power to a downhole resistive heater element as opposed to an ESP.

BRIEF DESCRIPTION OF THE DRAWINGS

So that the manner in which the present inventions can be better understood, certain illustrations are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
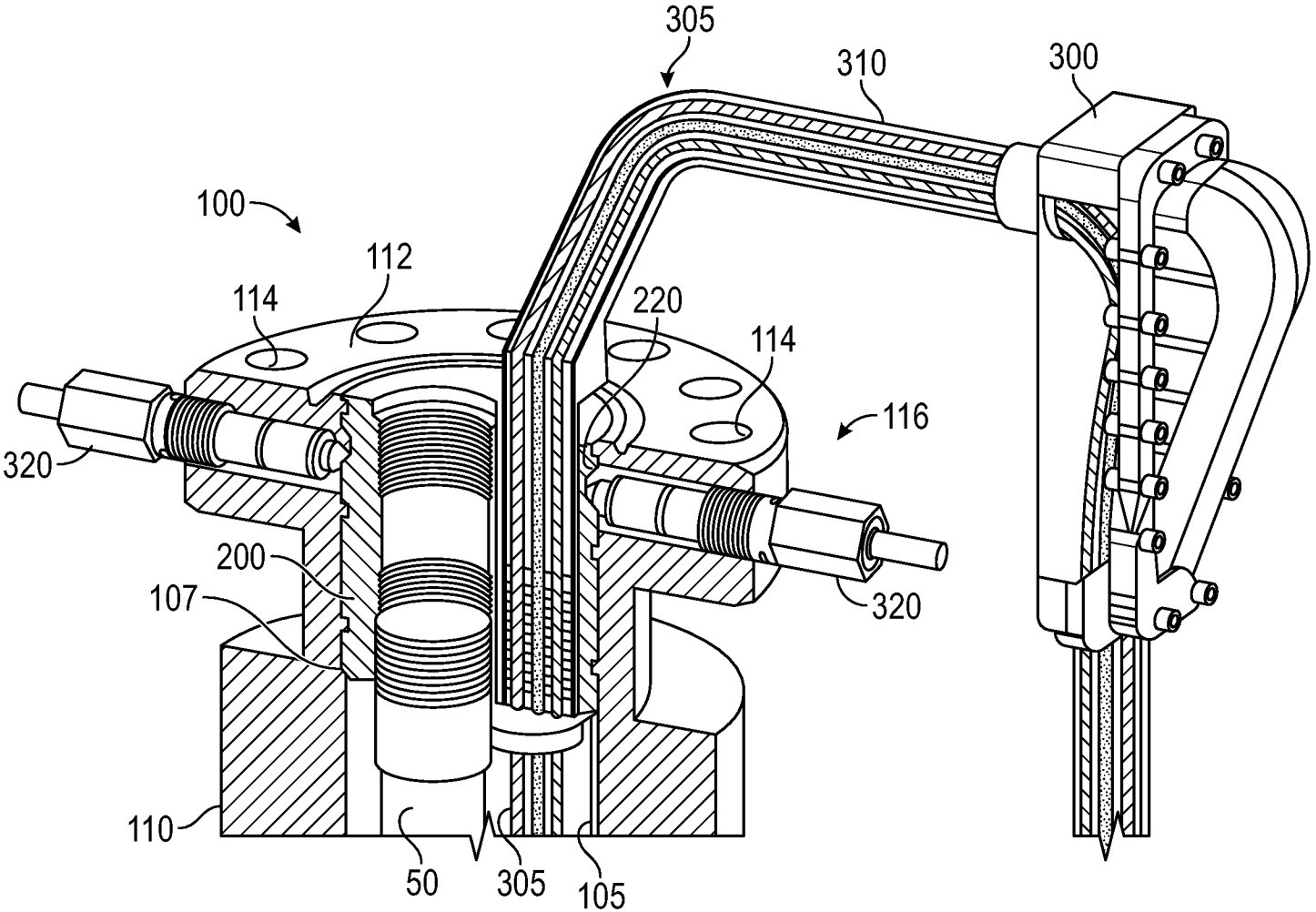
FIG. 1 is a partial cut-away view of a tubing head and a tubing hanger. The tubing hanger has landed on a conical inner surface of the tubing head, and is gravitationally supporting a string of production tubing from the surface. The tubing hanger includes an auxiliary port parallel with but offset from a vertical axis of the tubing string.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and wellbore fines, and combinations of gases, liquids, and fines.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types.

As used herein, the term "communication line" or "communications line" refers to any line capable of transmitting signals or data. The term also refers to any insulated line capable of carrying an electrical current, such as for power. The term "conduit" may be used in lieu of communications line.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Description of Selected Specific Embodiments

An improved tubing hanger assembly is provided herein. The tubing hanger assembly is used to suspend a tubing string within a wellbore. The tubing hanger assembly includes a tubing hanger configured to gravitationally land on a beveled surface along the inner diameter of a tubing head, and to suspend a string of production tubing from the surface. Beneficially, the tubing hanger assembly is arranged to receive a continuous power cable from a power source at the surface and through the tubing hanger assembly, without the conductive wires being spliced.

FIG. 1 is a cut-away view of a tubing head 100. The tubing head 100 is a known tubing head (sometimes referred to as a "tubing spool") that is configured to reside over a wellbore (see, e.g., wellbore 1200 in FIG. 12). The tubing head helps in sealing production fluids from the wellbore at the surface. The "surface" may be a land surface; alternatively, the surface may be an ocean bottom or a lake bottom, or a production platform offshore.

The tubing head 100 defines a generally cylindrical body 110 having an outer surface (or outer diameter) and an inner surface (or inner diameter). The inner surface forms a bore 105 which is dimensioned to receive a tubing hanger 200. Features of the tubing hanger 200 are described further below in connection with FIGS. 2 through 4.

The tubing head 100 and the tubing hanger 200 together may be referred to as a tubing hanger assembly. The purpose of the tubing hanger assembly is to support a string of production tubing 50 from the surface. It is understood that the tubing hanger assembly is a part of a larger wellhead (not shown, but well-familiar to those of ordinary skill in the art) used to control and direct production fluids from the wellbore and to enable access to the "back side" of the tubing string 50.

As seen in FIG. 1, the tubing hanger 200 has landed on a conical surface 107 of the tubing head 100. The conical surface 107 is dimensioned to receive a matching beveled surface (shown at 207 of FIG. 2) of the tubing hanger 200. In this way, the tubing hanger 200 (and connected tubing string 50) is gravitationally supported by the tubing head 100.

The tubing head 100 comprises an upper flange 112. The upper flange 112 includes a series of holes 114 radially disposed and equidistantly place along the upper flange 112. The holes 114 are configured to receive bolts (not shown) having ACME threads. The bolts secure the upper flange 112 to a separate flanged body (not shown) that makes up a portion of a "Christmas Tree."

The upper flange 112 includes opposing through-openings 116. The through openings 116 threadedly receive respective lock pins 320. The lock pins 320 help secure the tubing hanger 200 in place. The lock pins 320 include a distal end that may be translated into engagement with the tubing hanger 200. More specifically, the distal end of the lock pins 320 engage a reduced inner diameter portion (shown at 203 in FIG. 2) of the tubing hanger 200. When engaged, the locking pins 320 prevent relative rotation of the tubing hanger 200 and connected tubing string 50 within the bore 105 of the tubing head 100.

In the view of FIG. 1, a tubing hanger 200 has been placed within the inner surface 105 of the tubing head 100. The tubing hanger 200 comprises a generally tubular body 210 having a central bore 205. The tubing hanger 200 is configured to be closely received within the inner surface (or bore) 105 of the tubing head 100.

Figure 2:
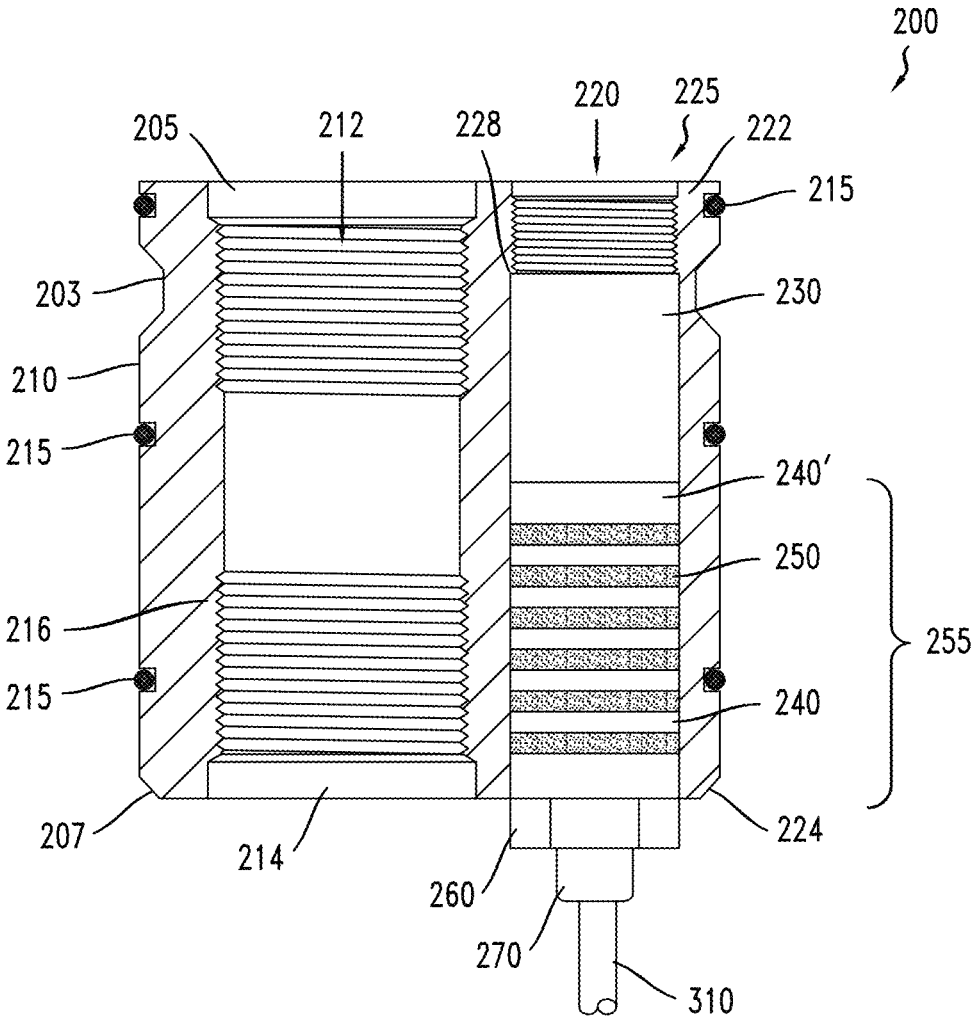
FIG. 2 is a cross-sectional view of the tubing hanger of the present invention, in one embodiment. The auxiliary port for receiving a communications line (such as a power cable) is shown in cut-away view.

FIG. 2 is a cross-sectional view of the tubing hanger 200 of the present invention, in one embodiment. The tubular body 210 making up the tubing hanger 200 is shown along with the central bore 205. The tubular body 210 includes an upper end 212 and a lower end 214. Each of the upper 212 and lower 214 ends comprises female threads within the bore 205, representing upper threads and lower threads. The lower threads are configured to connect to the upper pin end of a joint of tubing 50, making up a tubing connection 216. That joint of tubing 50 becomes the uppermost tubing joint in a string of production tubing that is run into a wellbore during completion.

The tubular body 210 of the tubing hanger 200 defines an outer surface (or outer diameter). As shown in FIG. 1, the outer surface of the tubing hanger 200 is dimensioned to be closely received within the inner diameter of the tubing head 100. As noted, the tubing hanger 200 includes a beveled surface 207. In the preferred arrangement, the beveled surface 207 resides proximate the lower end 214 of the tubing hanger 200. The beveled surface 207 is configured to land on the matching conical surface 107 of the tubing head 100. In this way, the tubing hanger 200 and connected tubing string 50 are gravitationally supported at the top of the wellbore.

The tubing hanger 200 includes a series of o-rings 215. The o-rings 215 provide a fluid seal between the outer surface of the tubing hanger 200 and the inner surface of the tubing head 100.

Of interest, the tubing hanger 200 also includes an auxiliary port 220. The auxiliary port 220 runs parallel with the central bore 205 of the tubing hanger 200. The auxiliary port 220 includes a top end 222 and a bottom end 224. The auxiliary port 220 defines a bore 225 from the top end 222 to the bottom end 224. The bore 225 slidably receives separated (but still insulated) conductive wires from a power cable (seen in FIG. 1 at 310).

Returning to FIG. 1, the power cable 310 is shown as three wires 305. These represent a traditional positive wire, a negative wire and a ground. Each of the positive, negative and ground wires is separated along the auxiliary port 220. This is done by removing the thick, insulating sheath from the power cable 310. Each of the conductive wires 305 will still have at least its own thin plastic insulation, but the thick, insulating sheath for the power cable 310 is removed along the auxiliary port 220.

For purposes of the present disclosure, the power cable 310 is designed to supply power from a power box 300 to an electrical submersible pump (or "ESP," not shown) downhole. The power cable 305 extends from the electrical box 300, through an NPT connection at the auxiliary port 220, through the auxiliary port 220, down the wellbore and then to the ESP.

A shoulder 228 is machined into the upper end of the auxiliary port 220. A thin but rigid, non-conductive sleeve 230 is placed along the auxiliary port 220 against the shoulder 228. The sleeve 230 provides a smooth entrance for the wires 305 into the auxiliary port 220 while also providing electrical insulation between the unsheathed wires 305 and the tubular metal body 210.

The non-conductive sleeve 230 defines a cylindrical body and is preferably fabricated from a rigid plastic material such as PEEK. "PEEK" is an acronym for polyetheretherketone. PEEK is a high-performance engineering plastic known for its mechanical strength and dimensional stability.

PEEK is also known for its resistance to harsh chemicals. PEEK material offers hydrolysis resistance and can maintain stiffness at high temperatures, such as up to 330° F. The non-conductive sleeve 230 may be, for example, four inches in length and have an inner diameter of 0.5 inches.

In addition to the rigid sleeve 230, a series of discs is provided for the bore 225. These preferably represent alternating rigid 240 and elastomeric 250 discs. As described further below in connection with FIGS. 9, 10 and 11, the discs 240, 250 maintain the electrical wires associated with the power cable 305 suitably separated, both from each other and from the conductive tubular body 210.

In one optional aspect, an uppermost rigid disc 240' has a thickness that is greater than the other rigid discs 240. Optionally, four to eight rigid discs 240 fabricated from PEEK are provided, with an uppermost and a lowermost rigid disc 240' having a thickness that is greater than the intermediate discs 240. In any event, the elastomeric discs 250 are preferably spaced in alternating arrangement between the rigid discs 240, forming a disc stack 255. The disc stack 255 may also be referred to as packing.

Below the series of discs 240, 250 is a bottom plate 260. The bottom plate 260 is used to secure the disc stack 255 within the auxiliary port 220. At least some degree of compression is applied onto the bottom plate 260 and through the disc stack 255 in order to "energize" the elastomeric discs 250. In this way, the bore 225 of the auxiliary port 220 is fluidically sealed from the wellbore below.

In a preferred embodiment, "energizing" means that the operator applies mechanical compression to the disc stack 255 in order to cause the neoprene material making up the elastomeric discs 250 to expand. However, in one aspect the material making up the elastomeric discs 250 is reactive to wellbore fluids, causing the discs 250 to still further expand.

Figure 8A:
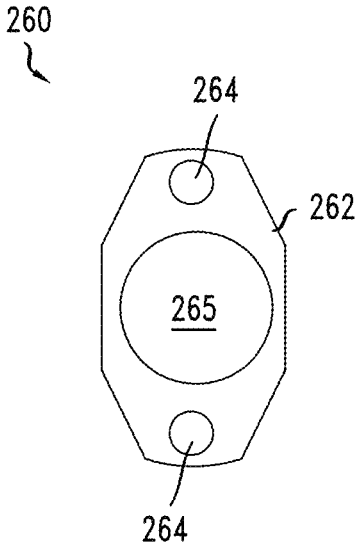
FIG. 8A is a top view of a bottom plate of the tubing hanger of FIG. 2. The bottom plate is used to support and to compress elastomeric discs for sealing the auxiliary port.

The bottom plate 260 may include a central through-opening, designated as element 265 in FIG. 8A. The through-opening 265 is dimensioned to receive the conductive wires 305 as they exit the tubing hanger 200. Below the bottom plate 260, the conductive wires 305 have their thick, insulating sheath, again forming a power cable 310 that will extend down the wellbore and to the ESP. A portion of the cable 310 is shown in FIG. 2, exiting the tubing hanger 200 with the three wires 305 bundled therein.

Finally, the tubing hanger 200 includes a bolt 270. More specifically, and as shown in the exploded view of FIG. 4, a pair of bolts 270 is provided. The bolts 270 reside on opposing sides of the through-opening 265 and are used to secure the bottom plate 260 to the lower end 224 of the tubing hanger body 210 using, for example, ACME threads.

Figure 3:
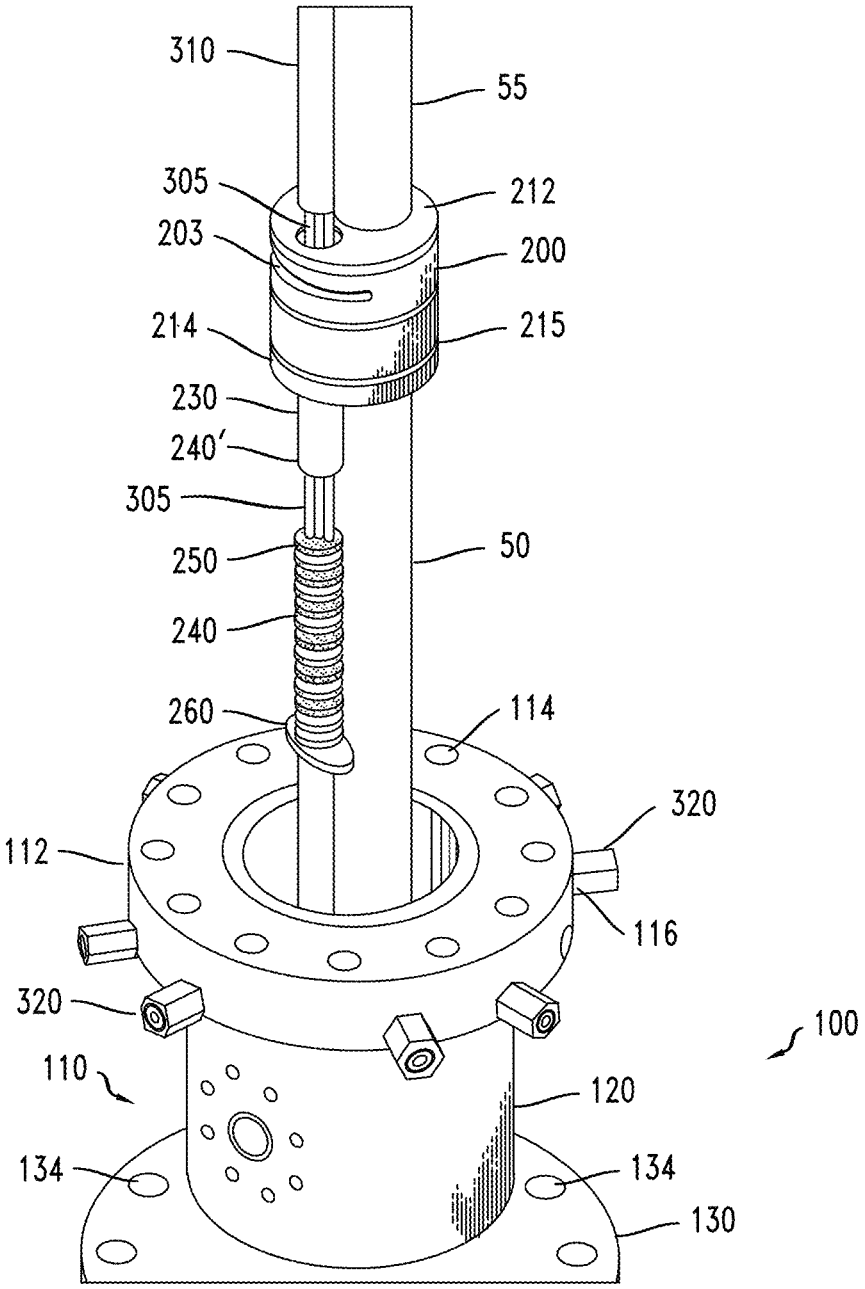
FIG. 3 is a partial perspective view of the tubing hanger of the present invention, in one embodiment. Here, the tubing hanger is connected to an uppermost joint of a production tubing string. The tubing hanger and tubing string are being lowered into the tubing head.

FIG. 3 is a perspective view of the tubing hanger 100 of the present invention, in one embodiment. Here, the tubing hanger 200 is connected to an uppermost joint of a production tubing string 50. In addition, a power cable 305 is shown extending through the tubing hanger 200 and down into the tubing head 100.

At a top of FIG. 3 is a landing tubing joint 55. This is a joint of tubing that is simply a working joint. The tubing joint 55 is threadedly connected to the upper threads of the tubing hanger 200 at the upper end 212. The tubing joint 55 and connected tubing hanger 200 may then be lowered into the tubing head 100 and into the wellbore using the draw works of the rig (not shown).

Also at the top of FIG. 3 is seen the power cable 310. The thick, outer sheath of the power cable 305 is removed as it enters the auxiliary port 220, and then down through the non-conductive sleeve 230 and the various discs 240, 250. Below the alternating discs 240, 250, the conductive wires 305 pass through the bottom plate 260 and down into the wellbore. It is understood that the power cable 310 is clamped to selected joints of production tubing 50 en route to the ESP.

FIG. 3 also shows a fuller view of the tubing head 100. Here, it is observed that the cylindrical body 110 of the tubing head 100 comprises three primary portions. These represent the upper flange 112, a central body portion 120, and a lower flange 130. It can again be seen that the upper flange 112 includes a series of holes 114 radially disposed and equidistantly place along the upper flange 112. The upper flange 112 also includes a plurality of through-openings or ports 116 configured to threadedly receive the respective lock pins 320.

The lower flange 130 also includes a series of holes 134 radially disposed and equidistantly place along the lower flange 130. The holes 134 are used to secure the tubing head to a lower plate (not shown) disposed over the wellbore, using ACME-threaded bolts.

Figure 4:
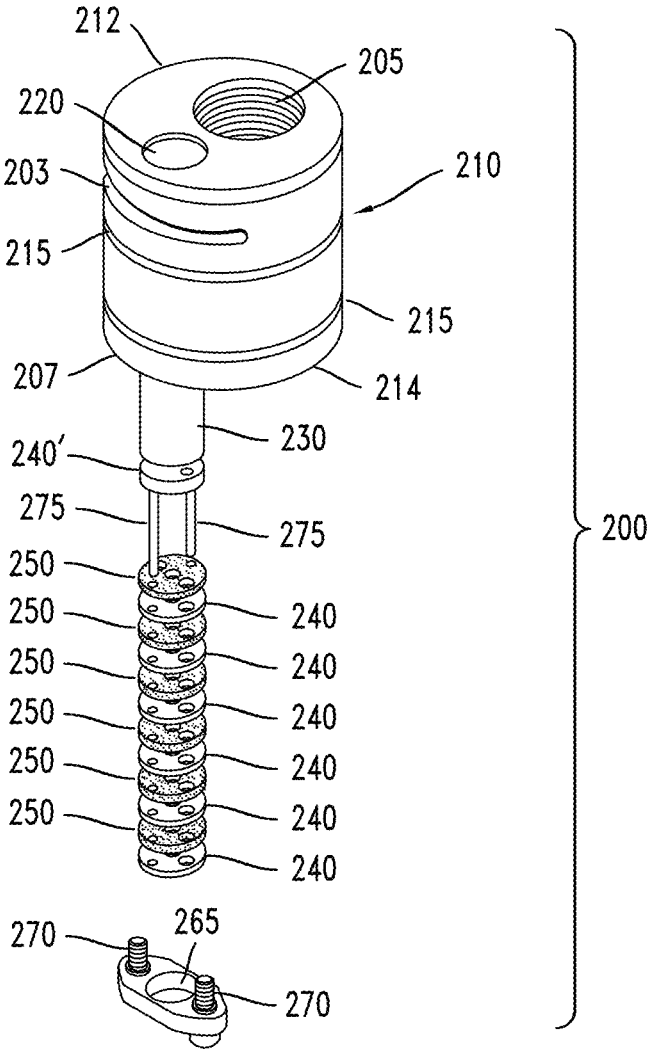
FIG. 4 is a perspective view of the tubing hanger of FIG. 3, without the tubing head. Parts of the tubing hanger are shown in exploded apart relation.

FIG. 4 is a perspective view of the tubing hanger 200 of FIG. 3, without the tubing head 100. Both the central bore 205 and the auxiliary port 220 are shown in perspective. Additional parts of the tubing hanger 200 are shown in exploded apart relation including illustrative stacked discs 240', 240, 250.

Figure 9A:
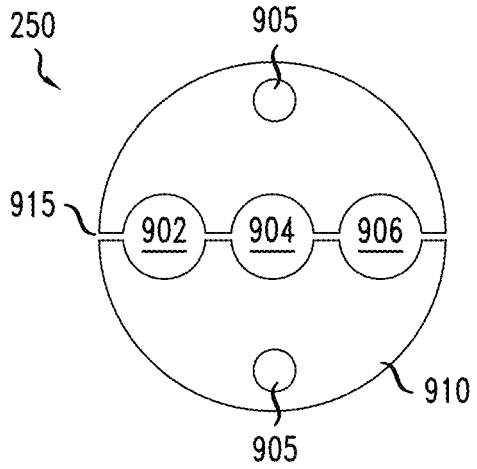
FIG. 9A is a top view of an elastomeric disc to be placed within the auxiliary port, in one embodiment. The elastomeric disc responds to compressive force supplied through the bottom plate.
Figure 10A:
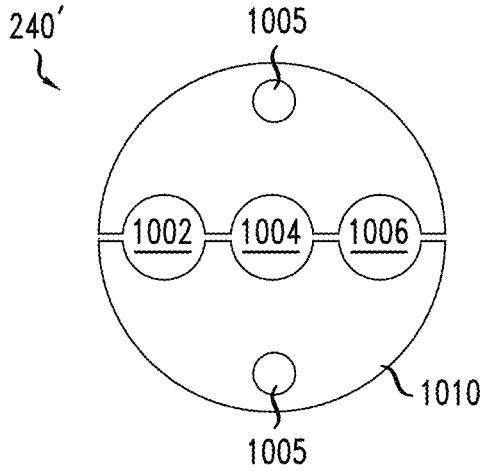
FIG. 10A is a top view of a "thick" disc fabricated from a rigid, non-conductive material as used in the tubing hanger of FIG. 2. The thick disc may be used as part of a stack of discs wherein elastomeric and rigid discs alternate in series within the auxiliary port.
Figure 11A:
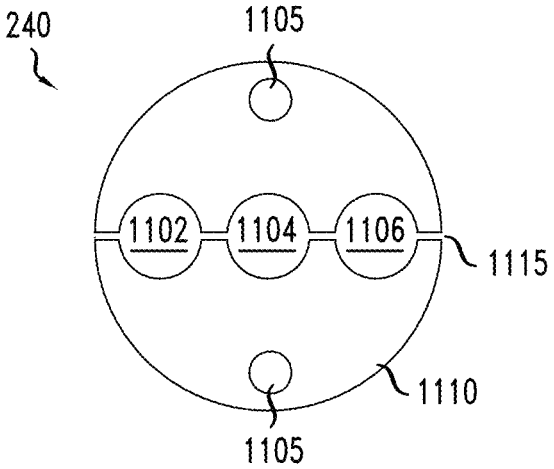
FIG. 11A is a top view of a "thin" disc fabricated from a rigid, non-conductive material as used in the tubing hanger of FIG. 2. The thin disc is also used as part of a stack of discs wherein conductive and rigid discs alternate in series within the auxiliary port.

In FIG. 4, each of the stacked discs 240', 240, 250 may contain three separate through-openings, with each opening being arranged to receive a respective wire 305 from the power cable 310. The through-openings for the elastomeric disc 250 are shown in FIG. 9A at 902, 904 and 906; the through-openings for the "thick" rigid disc 240' are shown in FIG. 10A at 1002, 1004 and 1006; and the through-openings for the "thin" rigid disc 240 are shown in FIG. 11A at 1102, 1104 and 1106.

Also noted from FIG. 4 is that each of the stacked discs 240', 240, 250 contains two opposing through-openings. The pair of through-openings for the elastomeric disc 250 are shown in FIG. 9A at 905; the through-openings for the large rigid disc 240' are shown in FIG. 10A at 1005; and the opposing pair of through-openings for the small rigid disc 240 are shown in FIG. 11A at 1105. Each of these openings is arranged to receive a respective alignment pin (seen at 275 in FIGS. 4 and 6C).

Also visible in FIG. 4 are the two bolts 270. The bolts 270 are shown extending through through-openings in the bottom plate 260. The through openings are shown at 264 in FIG. 8A. The bolts 270 secure the bottom plate 260 and the discs 240', 240, 250 in place along the auxiliary port 220.

Figure 5A:
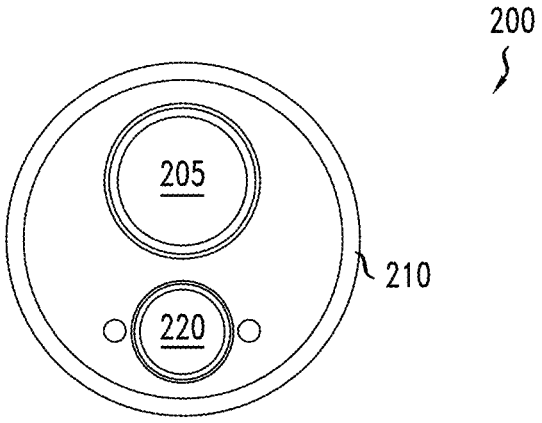
FIG. 5A is a bottom view of a tubular body making up the tubing hanger of FIG. 3.

FIG. 5A is a bottom view of the tubular body 210 defining the linger hanger 200 of FIG. 3. The central bore 205 for receiving production fluids (through production tubing 50) is shown. Also shown is the auxiliary port 220 through which the conductive wires 305 of the power cable 310 pass.

Figure 5B:
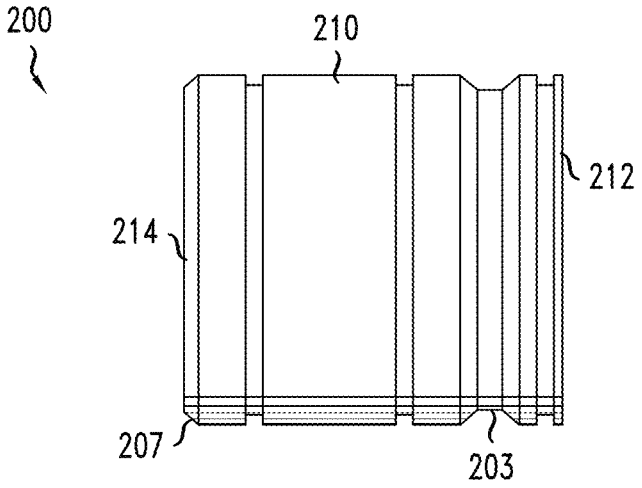
FIG. 5B is a side view of the tubing hanger.

FIG. 5B is a side view of the tubing hanger 200 of FIG. 2. The opposing top 212 and bottom 214 ends are indicated. Of interest, the recessed outer diameter portion 203 that receives the lock pins 320 is visible. Also seen is the lower beveled edge 207.

Figure 5C:
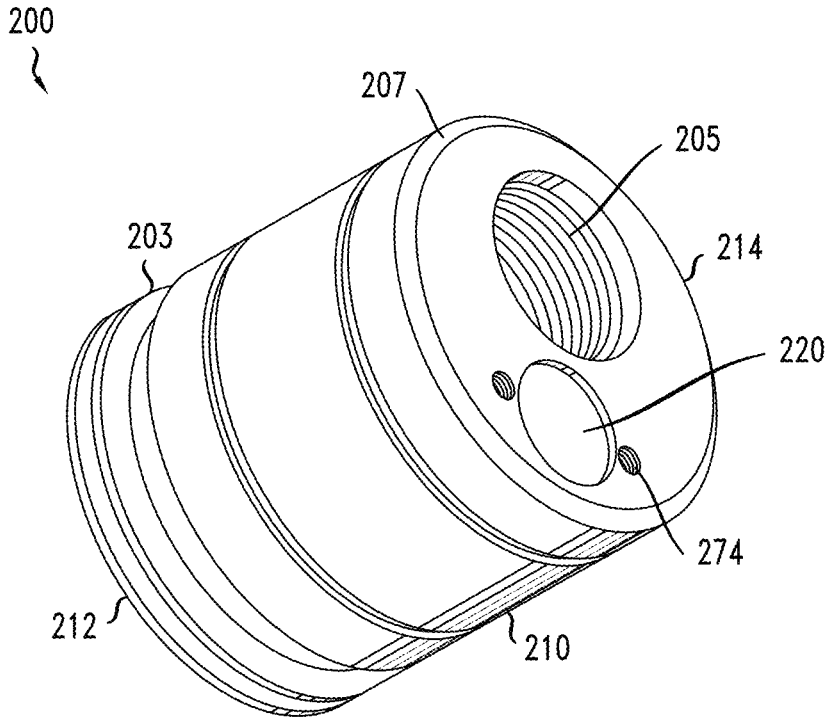
FIG. 5C is a perspective view of the tubing hanger.

FIG. 5C is a perspective view of the tubing hanger 200 of FIG. 2. The view is taken from the bottom end 214. A pair of bolt openings 274 is seen at the bottom end 214. In addition, female threads are seen along the bore 205 for receiving a pup joint that connects the tubing hanger 200 with the uppermost joint of production tubing 50.

Figure 6A:
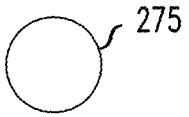
FIG. 6A is an end view of an alignment pin as may be used to align discs for receiving the power cable along the auxiliary port.

FIG. 6A is an end view of an alignment pin 275. The alignment pin 275 is used to align the discs 240', 240, 250 within the auxiliary port 220. This allows the discs 240', 240, 250 to slidably receive the conductive wires 305 en route to the wellbore. Preferably, the alignment pins 275 are fabricated from a polycarbonate material or from PEEK.

Figure 6B:
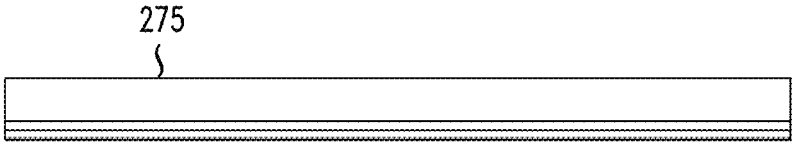
FIG. 6B is a side view of the alignment pin of FIG. 6A.
Figure 6C:
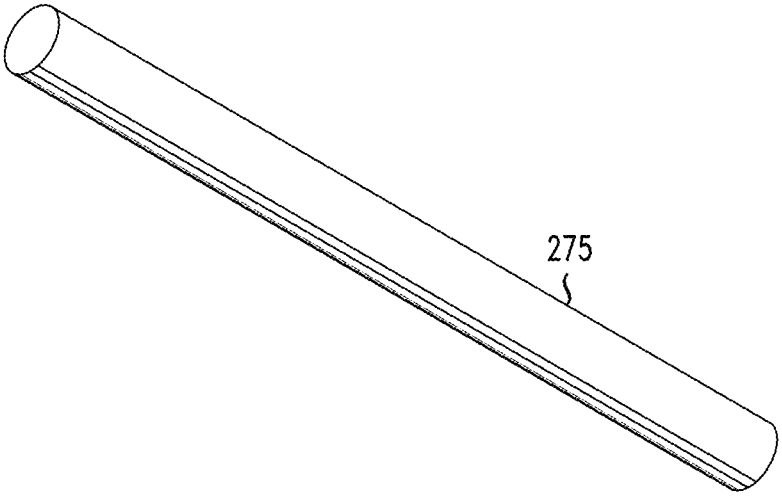
FIG. 6C is a perspective view of the alignment pin of FIG. 6A.

FIG. 6B is a side view of the alignment pin 275 of FIG. 6A. FIG. 6C is a perspective view of the alignment pin 275 of FIG. 6A. In one embodiment, the alignment pins 275 are 10 inches in length and 0.25 inches in diameter. The alignment pins 275 are dimensioned to pass through the through-openings 905, 1005 and 1105 of discs 240', 240 and 250, respectively. The length of the alignment pins 275 is less than a length of the bore 225.

Figure 7A:
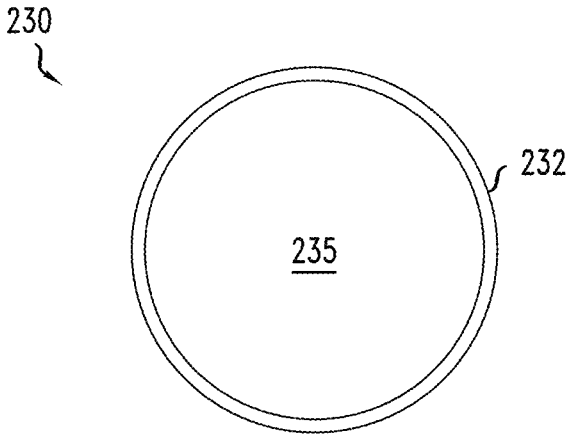
FIG. 7A is an end view of an optional rigid, non-conductive sleeve of the tubing hanger of FIG. 2.

FIG. 7A is an end view of the non-conductive sleeve 230 of the tubing hanger 200 of FIG. 2. The non-conductive sleeve 230 defines a tubular body having a wall 232 and a through opening 235. The non-conductive sleeve 230 is preferably fabricated from a plastic material such as PEEK.

Figure 7B:
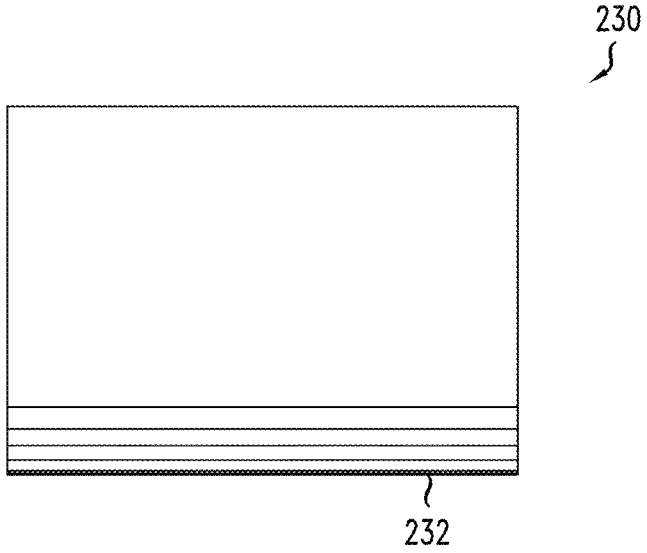
FIG. 7B is a side view of the non-conductive sleeve of FIG. 7A.
Figure 7C:
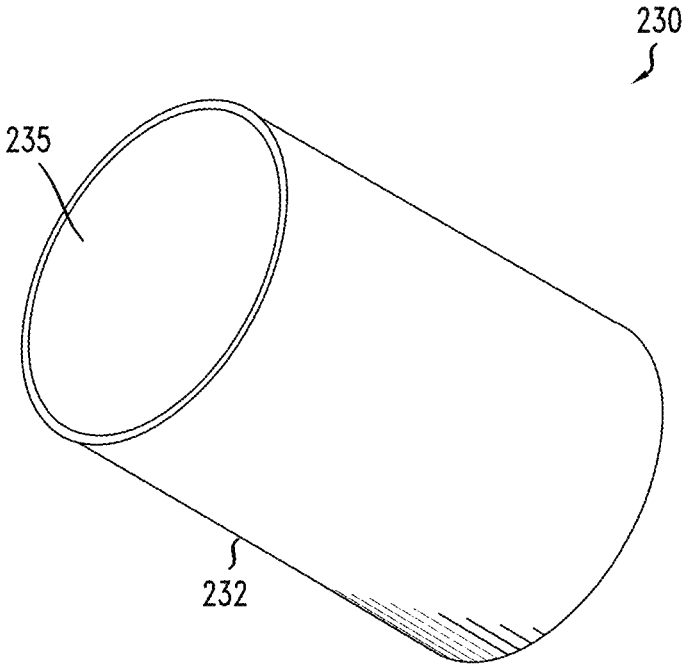
FIG. 7C is a perspective view of the non-conductive sleeve.

FIG. 7B is a side view of the non-conductive sleeve 230. FIG. 7C is a perspective view of the non-conductive sleeve 230. In one embodiment, the sleeve 230 is 4 inches in length and has an inner diameter of 0.5 inches. The sleeve 230 is dimensioned to reside within the auxiliary port 220 near the top end 212 of the tubing hanger 200.

FIG. 8A is a top view of a bottom plate 260 of the tubing hanger 200 of FIG. 2. The bottom plate 260 resides below the auxiliary port 220 at the bottom end 214 of the tubing hanger 200.

Figure 8B:
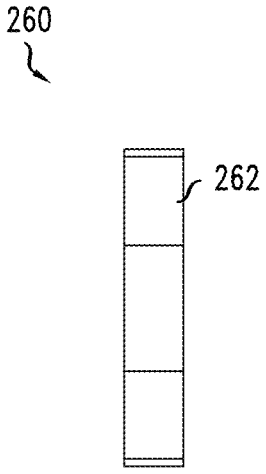
FIG. 8B is a side view of the bottom plate of FIG. 8A.
Figure 8C:
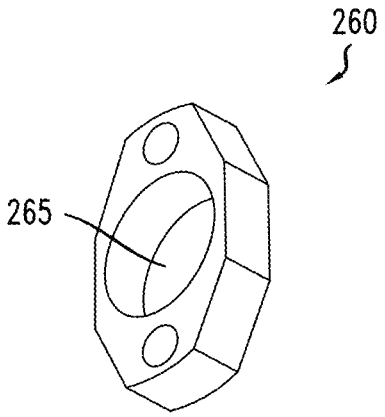
FIG. 8C is a perspective view of the bottom plate of FIG. 8A.

FIG. 8B is a side view of the bottom plate 260 of FIG. 8A. FIG. 8C is a perspective view of the bottom plate 260.

The bottom plate 260 contains a pair of opposing through openings 264. The through openings 264 are dimensioned to receive respective bolts 270. The bolts 270 are threaded into openings 274 at the bottom end 224 of the tubing hanger 220 to secure the bottom plate 260 to the tubing hanger 220. The bolts 270 have been removed for illustrative purposes.

The bottom plate 260 also contains a central through opening 265. The central through opening 265 is dimensioned to receive the power cable 310 (or at least the unsheathed conductive wires 305 before they are re-sheathed) en route to the wellbore. Of interest, the central through opening 265 has a diameter that is smaller than the outer diameter of the discs 240', 240, 250. In this way, the bottom plate can retain the discs 240, 250 within the auxiliary port 220.

FIG. 9A is a top or end view of an elastomeric disc 250. The elastomeric disc 250 is designed to be placed within the bore 225 of the auxiliary port 220. More specifically, a series of two, three, four, or more elastomeric discs 250 are aligned in series within the auxiliary port 220 as part of the disc stack 255.

Figure 9B:
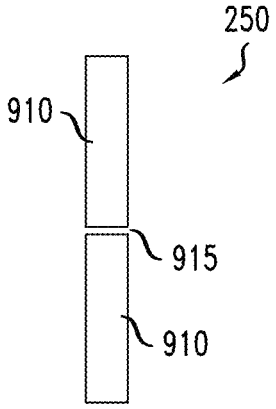
FIG. 9B is a side view of the elastomeric disc of FIG. 9A.
Figure 9C:
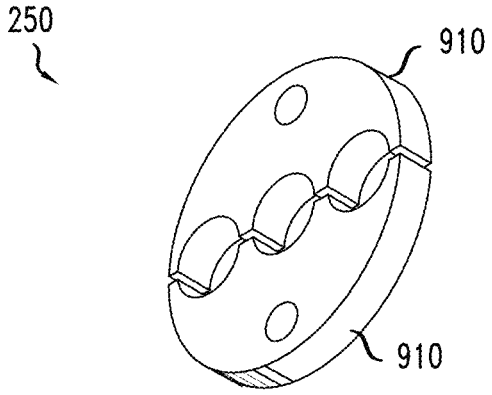
FIGS. 9C and 9D are perspective views of the elastomeric disc of FIG. 9A, taken from opposing ends.
Figure 9D:
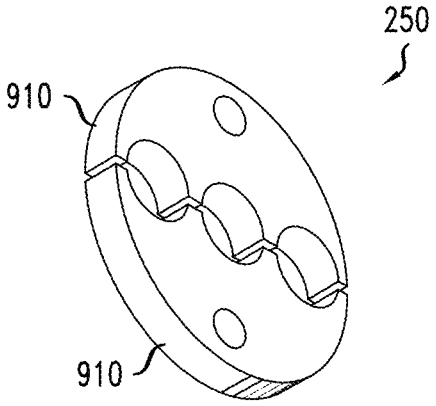

FIG. 9B is a side view of the elastomeric disc 250 of FIG. 9A. FIGS. 9C and 9D are perspective views of the elastomeric disc 250 of FIG. 9A, taken from opposing ends.

The elastomeric disc 250 is fabricated from a pliable and electrically non-conductive material such as neoprene. The elastomeric disc 250 defines a cylindrical body 910. The disc 250 comprises a pair of opposing through openings 905 placed through the body 910. The through openings 905 are dimensioned to receive respective alignment pins 275.

The elastomeric disc 250 also comprises a series of central through openings 902, 904, 906, aligned in series along the body 910. Each central through opening 902, 904, 906 is intended to receive a respective wire 305 from the power cable 310.

It is observed that the elastomeric disc 250 may be split in half. A dividing line is shown at 915 indicating the split. This allows each elastomeric disc 250 to capture the respective wires 305 of the power cable 310 without having to run the individual wires separately through the disc 250.

FIG. 10A is a top view of a "thick" disc fabricated from a non-conductive material as used in the tubing hanger 200 of FIG. 2. The thick disc 240' may be used as part of a stack of discs wherein conductive 250 and non-conductive 240 discs alternate in series within the auxiliary port 220.

Figure 10B:
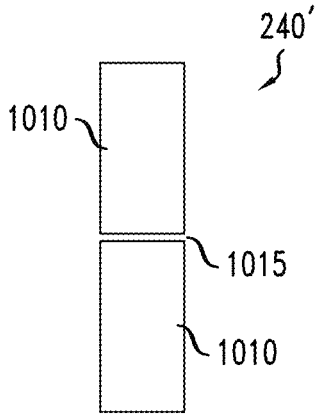
FIG. 10B is a side view of the thick disc of FIG. 10A.
Figure 10C:
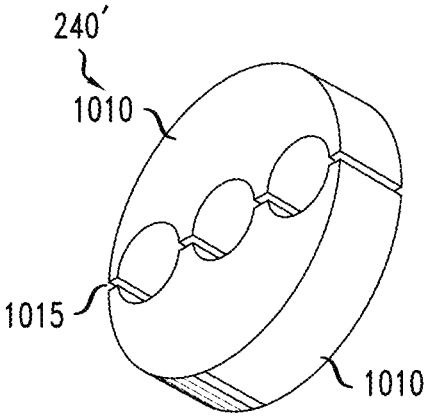
FIGS. 10C and 10D are perspective views of the thick disc of FIG. 10A, taken from opposing ends.
Figure 10D:
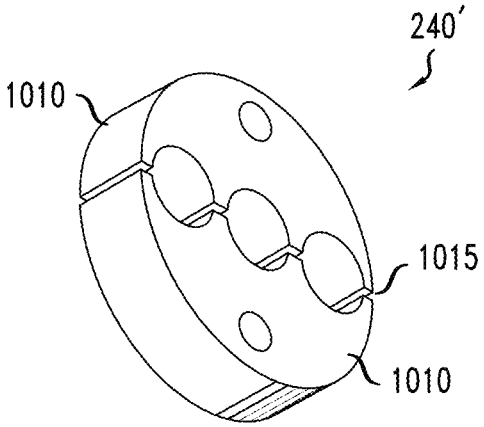

FIG. 10B is a side view of the thick disc 240' of FIG. 10A. FIGS. 10C and 10D are perspective views of the thick disc 240' of FIG. 10A, taken from opposing ends.

FIG. 11A is a top or end view of a "thin" disc 240 fabricated from a non-conductive material as used in the tubing hanger 200 of FIG. 2. The thin disc 240 is also used as part of a stack of discs wherein conductive 250 and non-conductive 240 discs alternate in series within the auxiliary port 220.

Figure 11B:
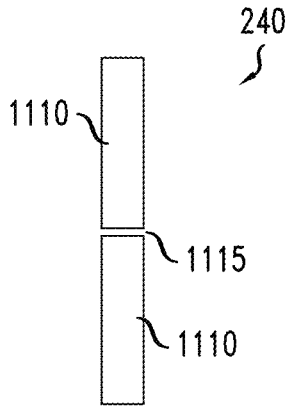
FIG. 11B is a side view of the thin disc of FIG. 11A.
Figure 11C:
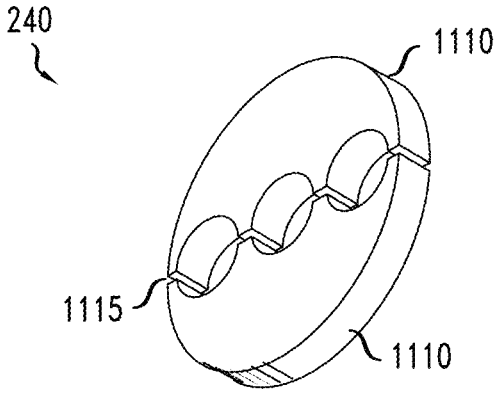
FIGS. 11C and 11D are perspective views of the thin disc of FIG. 11A, taken from opposing ends.
Figure 11D:
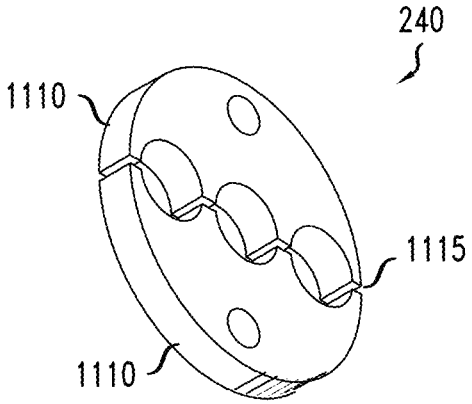

FIG. 11B is a side view of the thin disc 240 of FIG. 11A. FIGS. 11C and 11D are perspective views of the thin disc 240 of FIG. 11A, taken from opposing ends.

The conductive discs 240' and 240 are fabricated from the same material and have the same design. The only difference between the two is that the disc 240' of FIGS. 10A and 10B has a greater thickness than the disc 240 of FIGS. 11C and 11D. Each of the rigid discs 240', 240 is preferably fabricated from a polycarbonate material such as PEEK.

Each of the rigid discs 240', 240 defines a cylindrical body 1010, 1110. Each of the rigid discs 240', 240 comprises a pair of opposing through openings 1005, 1105 placed through the respective body 1010, 1110. The through openings 1005, 1105 are dimensioned to receive respective alignment pins 275.

As with the elastomeric disc 250, each of the rigid discs 240', 240 also comprises a series of central through openings. The central through openings for the thick disc 240' are shown at 1002, 1004 and 1006 while the central through openings for the thick disc 240 are shown at 1102, 1104 and 1106. The central through openings are aligned in series along their respective bodies 1010 or 1110. Each central through opening 1002, 1004, 1006 or 1102, 1104, 1106 is intended to receive a respective wire 305 from the power cable 310.

As with the elastomeric disc 250, each of the rigid discs 240', 240 is split in half. A dividing line for body 1010 is shown at 1015 indicating the split. Similarly, a dividing line for body 1110 is shown at 1115. This allows each disc 240', 240 to capture the respective wires 305 of the power cable 310 without having to run the individual wires 305 separately through the discs 240', 240.

As shown best in FIGS. 2 and 4, the conductive 250 and non-conductive 240 discs are spaced in alternating arrangement, forming a disc stack 255. Optionally, the thick discs 240' are placed at the top and/or bottom ends of the disc stack 255. During assembly, the discs 240', 240, 250 are opened into their respective halves. The three individual wires (having thin plastic insulation) 305 from the power cable 310 are separated and laid out in parallel along respective half-discs. The conductive wires 305 are (i) laid along the central through openings 902, 904, 906 for the elastomeric discs 250, (ii) laid along the central through openings 1002, 1004, 1006 for the thick rigid disc(s) 240', and are (iii) laid along the central through openings 1102, 1104, 1106 for the thin rigid discs 240. The half discs 240', 240, 250 are then put together to capture the unsheathed wires 305. Alignment pins 275 are run through the through openings 905, 1005, 1105 in the order in which the discs 240', 240, 250 are stacked to help maintain the half-discs in order and proper relation.

After the disc stack 255 is assembled and all wires 305 are in place, the disc stack and wires 305 are pushed up into the auxiliary port 220 from the bottom end 224. The operator will make a determination as to how many elastomeric discs 250 and rigid discs 240', 240 will make up the disc stack 255. Ideally, the disc stack 255 will be longer than the space available within the auxiliary port 220, taking into account the amount of space consumed by the non-conductive sleeve 230. The operator will then use the bottom plate 260 to push on the disc stack 255, compressing the elastomeric discs 250 so that a series of annular seals is provided along the auxiliary port 220.

When the elastomeric (neoprene) discs 250 are compressed, they expand outwardly and inwardly. Outwardly, the discs 250 expand into the wall of the auxiliary port 220 to provide a fluid seal. Inwardly, the discs 250 expand around the electrical wires 305, protecting the wires 305 from reservoir fluids during production. More importantly, the elastomeric discs 250 prevent the conductive electrical wires 305 from shorting out due to the loss of the outer insulating sheath and their proximity to the metal tubular body 210 of the tubing hanger 200. At the same time, the rigid (PEEK) plastic material of the rigid discs 240 helps centralize and separate the conductive wires 305 within the auxiliary port 220, keeping the wires 305 from contacting each other or the metal body 210 of the steel tubing hanger 200.

It is understood that during operation the disc stack 255 is exposed to wellbore pressures that may exceed 1,200 psi. Accordingly, the shoulder 228 is provided to help hold the sleeve 230 and the disc stack 255 in place.

Figure 12:
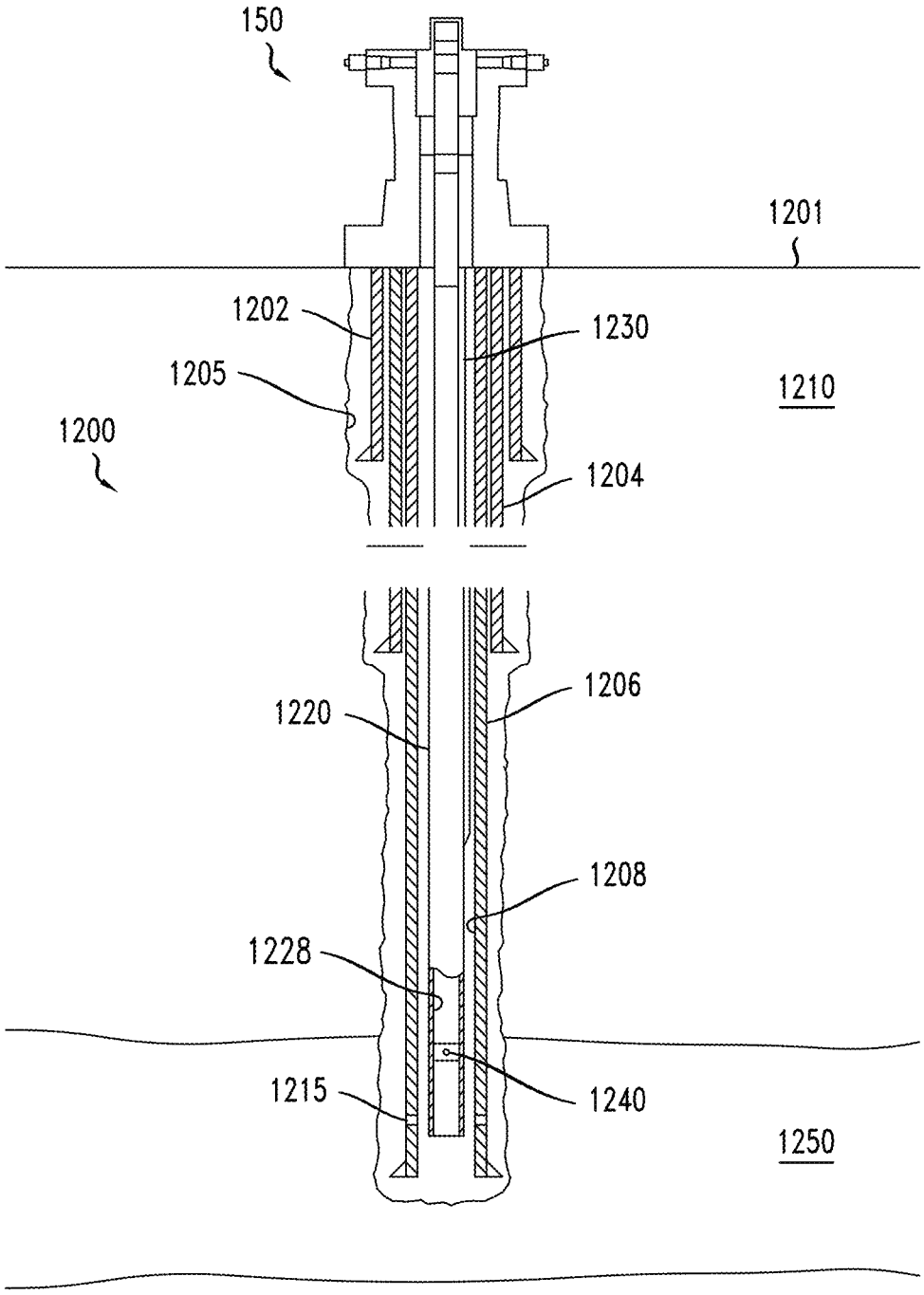
FIG. 12 is a cut-away view of a wellbore as may receive the tubing hanger assembly and connected tubing string of FIG. 1.

FIG. 12 is a cross-sectional view of a wellbore 1200 as may receive the tubing hanger assembly (indicated as 150) and connected tubing string (as indicated at 1220) of FIG. 1. The wellbore 1200 defines a bore 1205 that extends from a surface 1201, and into the earth's subsurface 1210. The wellbore 1200 has been formed for the purpose of producing hydrocarbon fluids for commercial sale. A string of production tubing 1220 is provided in the bore 1205 to transport production fluids from a subsurface formation 1250 up to the surface 1201. In the illustrative arrangement of FIG. 12, the surface 1201 is a land surface.

The wellbore 1200 includes a wellhead. Only the tubing hanger assembly 150 of FIG. 1 is shown (with the tubing hanger 200 therein). However, it is understood that the wellhead will include a production valve that controls the flow of production fluids from the production tubing 1220 to a flow line, and a back side valve that controls the flow of gases from a tubing-casing annulus 1208 up to the flow line. In addition, a subsurface safety valve (not shown) is typically placed along the tubing string 1220 below the surface 1201 to block the flow of fluids from the subsurface formation 1250 in the event of a rupture or catastrophic event at the surface 1201 or otherwise above the subsurface safety valve.

The wellbore 1200 will also have a pump 1240 at the level of or just above the subsurface formation 1250. In this view, the pump 1240 is an ESP. The pump 1240 is used to artificially lift production fluids up to the tubing head 100. Since an ESP is used, no reciprocating sucker rods are required or shown. However, a power cable such as cable 310 will be run from the surface 1201 down to the ESP 1240.

The wellbore 1200 has been completed by setting a series of pipes into the subsurface 1210. These pipes include a first string of casing 1202, sometimes known as surface casing. These pipes also include at least a second string of casing 1204, and frequently a third string of casing (not shown). The casing string 1204 is an intermediate casing string that provides support for walls of the wellbore 1200. Intermediate casing strings may be hung from the surface 1201, or they may be hung from a next higher casing string using an expandable liner or a liner hanger. It is understood that a pipe string that does not extend back to the surface is normally referred to as a "liner."

The wellbore 1200 is completed with a final string of casing, known as production casing 1206. The production casing 1206 extends down to the subsurface formation 1250. The casing string 1206 includes perforations 1215 which provide fluid communication between the bore 1205 and the surrounding subsurface formation 1250. In some instances, the final string of casing is a liner.

Each string of casing 1202, 1204, 1206 is set in place through cement (not shown). The cement is "squeezed" into the annular regions around the respective casing strings, and serves to isolate the various formations of the subsurface 1210 from the wellbore 1200 and each other. In some cases, an intermediate string of case or the production casing will not be cemented all the way up to the surface 1201, leaving a so-called trapped annulus.

As noted, the wellbore 1200 further includes a string of production tubing 1220. The production tubing 1220 has a bore 1228 that extends from the surface 1201 down into the subsurface formation 1250. The bore 1228 receives the ESP 1240. Thus, the production tubing 1220 serves as a conduit for the production of reservoir fluids, such as hydrocarbon liquids. An annular region 1208 is formed between the production tubing 1220 and the surrounding tubular casing 1206.

It is understood that the present inventions are not limited to the type of casing arrangement used. The wellbore 1200 is presented as an example of a wellbore arrangement where a power cable or digital cable or fiber optic cable may be utilized. In such an instance, the improved tubing hanger 200 of the present invention may be used.

Using the wellbore 1200, a method of hanging a string of production tubing within a wellbore is also provided. The method first comprises providing a tubing hanger assembly. The tubing hanger assembly includes a tubing head and a separate tubing hanger.

The tubing head has an upper end and a lower end. The upper end comprises a flange having a plurality of radially disposed through openings. The tubing head also includes a conical surface along an inner bore.

The tubing hanger defines a generally tubular body having an upper end, a lower end, and an outer diameter. A central bore extends from the upper end to the lower end of the tubular body. A beveled surface along the outer diameter lands on the conical surface of the tubing head.

The tubing hanger also includes an auxiliary port. The auxiliary port extends through the tubular body from the upper end to the lower end and is parallel to the central bore within the tubular body.

At least one elastomeric disc is placed within the auxiliary port. In addition, at least one rigid disc is also placed within the auxiliary port. Each of the elastomeric discs and the rigid discs is configured to receive conductive wires of a communications line, such as an electric power cable.

The method also includes the steps:

placing the tubing head over a wellbore;

running a string of production tubing into the wellbore;

clamping the communications line to joints of the production tubing as the string of production tubing is run into the wellbore;

securing the tubing hanger to an upper joint of the production tubing; and removing an outer insulating sheath from a length of the communications line, leaving at least one insulated conductive wire.

The method also includes the steps:

running the unsheathed communications line through the auxiliary port in the tubing hanger, wherein the unsheathed portion of the communications line resides along the auxiliary port;

placing the at least one elastomeric disc and the at least one rigid disc along the unsheathed portion of the communications line within the auxiliary port, forming a disc stack;

compressing the disc stack so that the at least one elastomeric disc seals the auxiliary port; and landing the beveled surface residing along the outer diameter of the tubing hanger on the conical surface along the inner diameter of the tubing head, whereby the tubing hanger resides within the tubing head over the wellbore and gravitationally supports the string of production tubing by means of a threaded connection with the tubing hanger.

In the preferred embodiment, the communications line is a power cable, and the power cable is in electrical communication with a downhole electrical submersible pump. The tubing hanger is arranged to receive the continuous power cable from a power source through the auxiliary port and into the wellbore, without the power cable being spliced. "Spliced" means exposing the copper wires.

The at least one elastomeric disc is configured to expand within the auxiliary port when compressed in order to seal the conductive wires and the auxiliary port from reservoir fluids. In addition, the at least one rigid disc is configured to retain rigidity within the auxiliary port during production operations to separate the conductive wires from the tubular body.

In one aspect, the tubing head further comprises two or more lock pins disposed equi-radially about the tubing head flange and passing through the through openings in the flange. The method further comprises rotating the lock pins into engagement with the tubing hanger to lock the tubing anger and supported tubing string in place within the tubing head.

Preferably, the at least one elastomeric disc comprises at least two elastomeric discs and the at least one rigid disc comprises at least two rigid discs. The elastomeric discs and the rigid discs are alternatingly stacked in series within the auxiliary port to form a disc stack.

The method may also include selecting a number of elastomeric discs to be included in the disc stack. The method then includes placing the disc stack into the auxiliary port through the bottom end, compressing the disc stack, and then securing the bottom plate to the bottom end of the tubing hanger in order to secure the disc stack and the conductive wires within the auxiliary port.

Preferably, the bottom plate comprises a central through-opening for receiving the conductive wires below the disc stack en route to the wellbore. The bottom plate is bolted to the bottom end of the tubular body.

In one aspect, the tubing hanger further comprises a pair of elongated alignment pins;

each of the elastomeric discs and each of the rigid discs comprises a pair of opposing through-openings configured to receive a respective alignment pin along the disc stack;

each of the at least two elastomeric discs is cut in half along the central through-openings to receive a respective conductive wire; and each of the at least two rigid discs is also cut in half along the central through-openings to receive a respective conductive wire.

This arrangement permits each of the respective disc halves to be placed back together before loading into the auxiliary port.

As can be seen, an improved tubing hanger assembly is provided that allows the operator to connect a power cable to a downhole tool such as an electrical submersible pump, without splicing conductive wires along the wellhead. While it will be apparent that the inventions herein described are well calculated to achieve the benefits and advantages set forth above, it will be appreciated that the inventions are susceptible to modification, variation and change without departing from the spirit thereof.

What is claimed is:

1. A tubing hanger assembly for suspending a tubing string within a wellbore, comprising:

a tubing head having an upper end and a lower end, wherein the upper end comprises a flange having a plurality of radially disposed through-openings, and wherein the tubing head defines a conical surface; and a tubing hanger configured to reside within the tubing head over the wellbore, and to support the tubing string by means of a threaded connection, wherein the tubing hanger comprises:

a generally tubular body having an upper end, a lower end and an outer diameter, with the outer diameter having a beveled surface configured to land on and to be gravitationally supported by the conical surface of the tubing head;

a central bore extending from the upper end to the lower end;

an auxiliary port also extending from the upper end to the lower end and being parallel to the central bore within the tubular body;

at least one elastomeric disc configured to reside within the auxiliary port, wherein the at least one elastomeric disc includes at least one wire opening that extends axially therethrough and at least one alignment opening that extends axially therethrough, wherein the at least one wire opening in the at least one elastomeric disc is configured to receive at least one conductive wire;

at least one rigid disc also configured to reside within the auxiliary port, wherein the at least one rigid disc includes at least one wire opening that extends axially therethrough and at least one alignment opening that extends axially therethrough, wherein the at least one wire opening in the at least one rigid disc is configured to receive the at least one conductive wire;

an alignment pin that is configured to extend axially through at least one alignment opening in the at least one elastomeric disc and the at least one alignment opening in the at least one rigid disc; and a bottom plate residing below the auxiliary port and securing the at least one elastomeric disc and the at least one rigid disc within the auxiliary port;

wherein:

the at least one elastomeric disc is configured to expand within the auxiliary port when compressed in order to seal the at least one conductive wire within the auxiliary port; and the at least one rigid disc is configured to retain rigidity within the auxiliary port during production operations.

2. The tubing hanger assembly of claim 1, wherein the tubing hanger is arranged to receive a continuous power cable from a power source into the wellbore, through the auxiliary port, without the power cable being spliced.

3. The tubing hanger assembly of claim 2, wherein:

the at least one conductive wire comprises three insulated wires from the power cable; and the at least one rigid disc is configured to separate the three insulated wires from one another and from the tubular body of the tubing hanger.

4. The tubing hanger assembly of claim 3, wherein:

the at least one elastomeric disc comprises at least two elastomeric discs;

the at least one rigid disc comprises at least two rigid discs; and the elastomeric discs and the rigid discs are stacked in series within the auxiliary port to form a disc stack.

5. The tubing hanger assembly of claim 4, wherein the at least two elastomeric discs and the at least two rigid discs are alternatingly stacked along the disc stack.

6. The tubing hanger assembly of claim 4, wherein:

each of the at least two elastomeric discs comprises three central through-openings for receiving respective conductive wires of the power cable;

each of the at least two rigid discs also comprises three central through-openings for receiving respective conductive wires of the power cable;

the central through-openings of the elastomeric discs and the central through-openings of the rigid discs are aligned along the disc stack; and the power cable retains an insulating sheath around the conductive wires above and below the auxiliary port, while each of the conductive wires retains its own insulation along the auxiliary port.

7. The tubing hanger assembly of claim 6, wherein the bottom plate:

comprises a central through-opening for receiving the conductive wires below the disc stack en route to the wellbore; and is bolted to the bottom end of the tubular body at the auxiliary port.

8. The tubing hanger assembly of claim 6, wherein:

the tubing head further comprises two or more lock pins disposed equi-radially about the tubing head flange, wherein the lock pins are configured to be received within the through ports of the tubing head flange and be rotated into engagement with the tubing hanger to rotatingly lock the tubing hanger and supported tubing string in place within the tubing head; and an upper end and a lower end of the central bore of the tubular body each comprises female threads for receiving a joint of tubing.

9. The tubing hanger assembly of claim 6, wherein:

each of the at least two elastomeric discs is cut in half along the central through-openings to receive a respective conductive wire; and each of the at least two rigid discs is also cut in half along the central through-openings to receive a respective conductive wire;

thereby permitting each of the respective disc halves to be placed back together before loading into the auxiliary port as the disc stack.

10. The tubing hanger assembly of claim 6, wherein the tubing hanger further comprises:

an upper shoulder along the auxiliary port;

a non-conductive sleeve residing within the auxiliary port above the disc stack and abutting the upper shoulder; and a pair of elongated alignment pins;

and wherein each of the at least two elastomeric discs and each of the at least two rigid discs comprises a pair of opposing through-openings configured to receive a respective alignment pin along the disc stack.

11. The tubing hanger assembly of claim 10, wherein:

the at least one rigid disc comprises at least four rigid discs comprising an uppermost rigid disc, a lowermost rigid disc, and intermediate rigid discs;

the uppermost disc and the lowermost disc of the rigid discs each has a thickness that is greater than a thickness of the intermediate rigid discs; and the elastomeric discs and the intermediate rigid discs are alternatingly stacked along the disc stack.

12. The tubing hanger assembly of claim 6, wherein:

each of the at least two elastomeric discs is fabricated from neoprene; and each of the at least two rigid discs is fabricated from a polycarbonate material or polyetheretherketone.

13. The tubing hanger assembly of claim 6, further comprising:

one or more o-rings around the tubing hanger.

14. The tubing hanger assembly of claim 1, wherein the tubing hanger is configured to receive a power cable comprising the at least one conductive wire, wherein the power cable comprises an insulating sheath around the at least one conductive wire above and below the auxiliary port, and wherein the insulating sheath is removed within the auxiliary port to allow the at last one conductive wire to be inserted into the at least one wire opening in the at least one elastomeric disc and the at least one wire opening in the at least one rigid disc.

15. The tubing hanger assembly of claim 14, wherein:

the at least one conductive wire comprises three wires;

the at least one wire opening in the at least one elastomeric disc comprises three wire openings;

the three wires are configured to be positioned within the three wire openings in the at least one elastomeric disc, which separates the three wires from one another and from the tubular body of the tubing hanger;

the at least one wire opening in the at least one rigid disc comprises three wire openings; and the three wires are configured to be positioned within the three wire openings in the at least one rigid disc, which separates the three wires from one another and from the tubular body of the tubing.

16. The tubing hanger assembly of claim 15, wherein:

the at least one elastomeric disc is cut in half through the three wire openings in the at least one elastomeric disc to facilitate inserting the three wires into the three wire openings in the at least one elastomeric disc; and the at least one rigid disc is cut in half through the three wire openings in the at least one rigid disc to facilitate inserting the three wires into the three wire openings in the at least one rigid disc.

* * * * *